United States Patent [19]

West

[11] Patent Number: 4,578,808

[45] Date of Patent: Mar. 25, 1986

[54] ELECTRO-ACOUSTIC TRANSDUCERS

[75] Inventor: Leslie L. West, Stapleford, England

[73] Assignee: Plessey Overseas Limited, Ilford, England

[21] Appl. No.: 457,358

[22] Filed: Jan. 12, 1983

[51] Int. Cl.[4] ..... H04R 11/00

[52] U.S. Cl. ..... 381/88; 179/115.5 R; 179/115 R

[58] Field of Search ..... 179/115 R, 119 R, 120, 179/117, 180, 179, 115.5 R; 381/87, 88

[56] References Cited

U.S. PATENT DOCUMENTS

| | | | |
|---|---|---|---|
| 3,324,253 | 6/1967 | Uemura | 179/117 |
| 3,497,638 | 2/1970 | Cohen | 179/115 R |
| 4,360,711 | 11/1982 | Steiner | 179/115 R |
| 4,425,482 | 1/1984 | Bordelon | 179/115 R |
| 4,443,667 | 4/1984 | Hunt | 179/115 R |

*Primary Examiner*—Gene Z. Rubinson
*Assistant Examiner*—L. C. Schroeder
*Attorney, Agent, or Firm*—Fleit, Jacobson, Cohn & Price

[57] ABSTRACT

A method of producing a transducer in which the fine tolerances are obtained by a two stage moulding process. Features include retention of the coil by the moulding process and accurate dimensioning of the magnet by depression of the soft iron core.

7 Claims, 4 Drawing Figures

ELECTRO-ACOUSTIC TRANSDUCERS

This invention relates to electro-acoustic transducers and more particularly but not exclusively to those adapted to be used as telephone earpieces or microphones. The invention also relates to a method of manufacturing such electro acoustic transducers.

It is desirable that telephone earpieces, tone callers and microphones are small, inherently sturdy, contain a small number of parts and are inexpensive. In order to ensure that the efficiency of a transducer is the optimum obtainable it is most important that the space within the transducer is used to the utmost advantage. It is also important that the number of joints in the magnetic circuit of the transducer are reduced to a minimum, and that the dimensions of gaps in the magnetic circuit are accurately determined and fixed during manufacture.

It is an object of the present invention therefore to provide an electro-acoustic transducer which will meet or substantially meet these requirements.

According to a feature of the present invention an electro-acoustic transducer comprises a first housing, a permanent magnet moulded in the first housing and a coil assembly mounted in the first housing adjacent to the magnet, the first housing including a location for an armature, the location providing a predetermined clearance between the magnet, the coil assembly and the armature, and a second housing moulded around the first housing so as to be bonded thereto, the second housing forming at least a portion of the outer walls of the transducer.

According to a further feature of the invention a method of making an electro-acoustic transducer comprises the steps of moulding a first housing around a ferromagnetic member, locating a coil assembly in the first housing adjacent to the ferromagnetic member and moulding a second housing around the first housing so as to be bonded thereto, the second housing forming at least a portion of the outer walls of the transducer.

Figure 1:
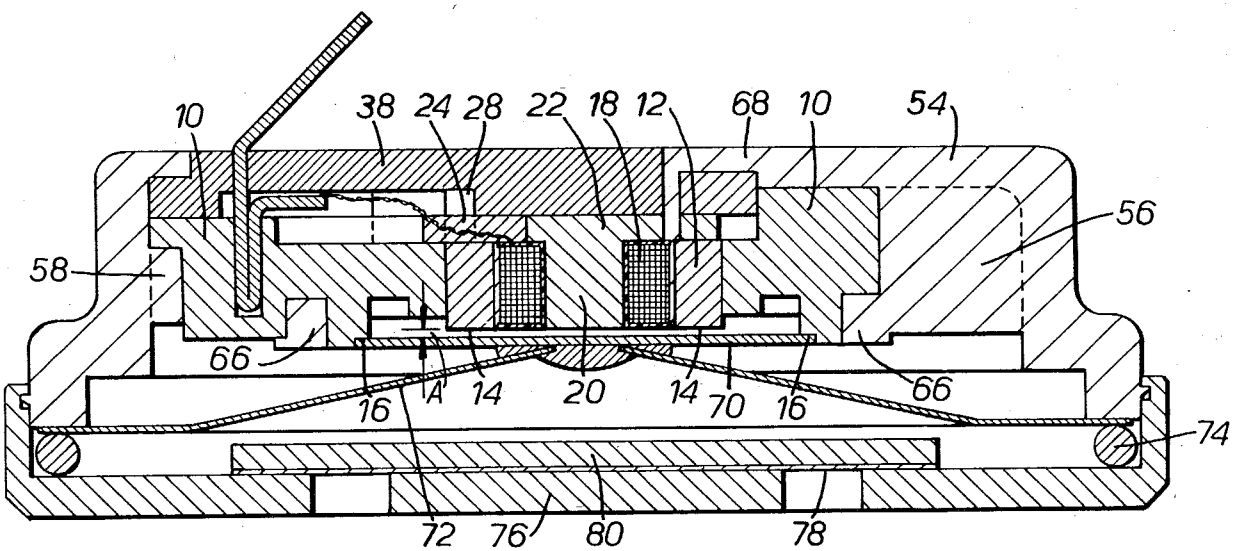
Figure 2:
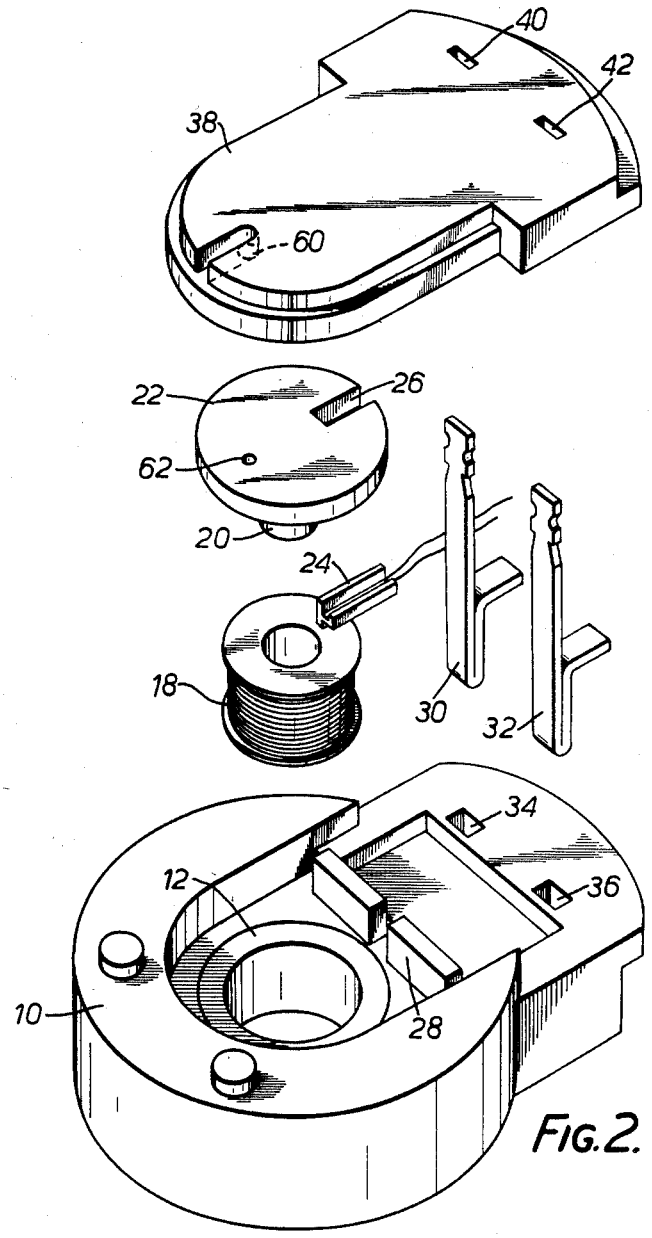
Figure 3:
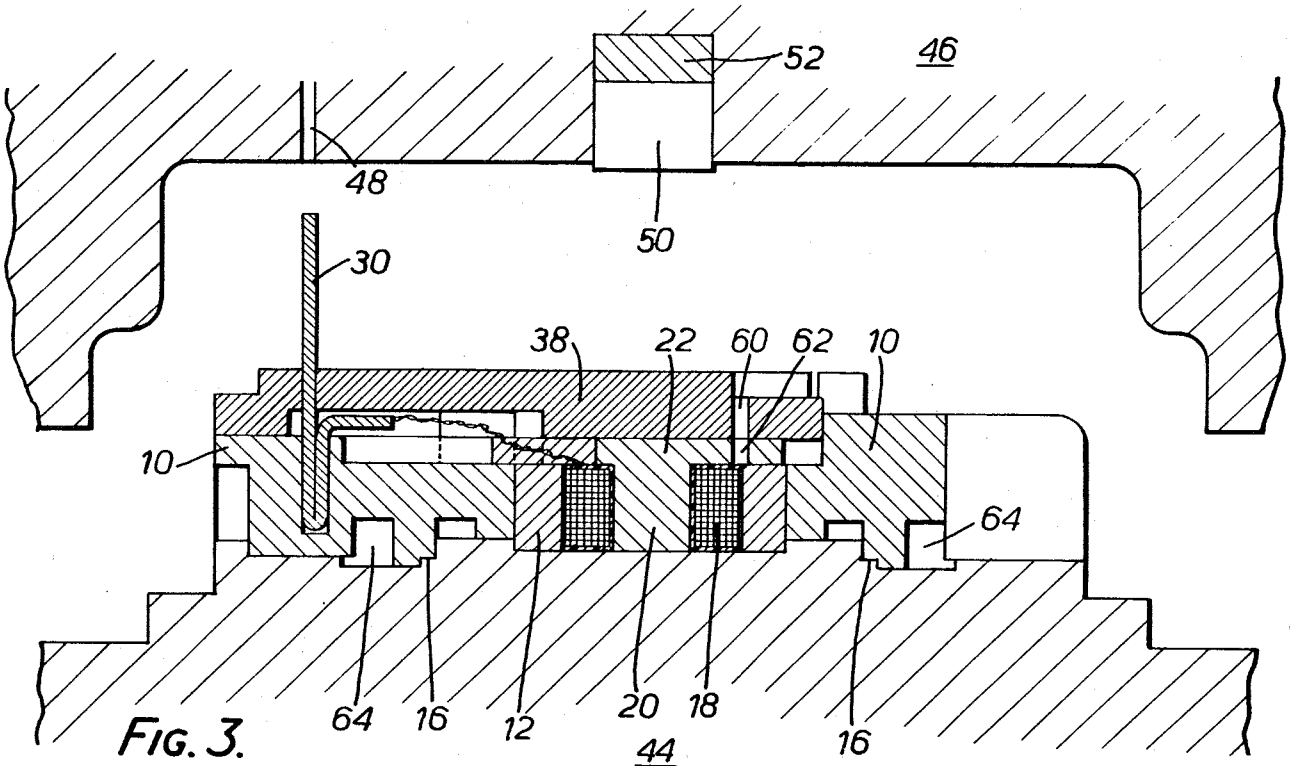
Figure 4:
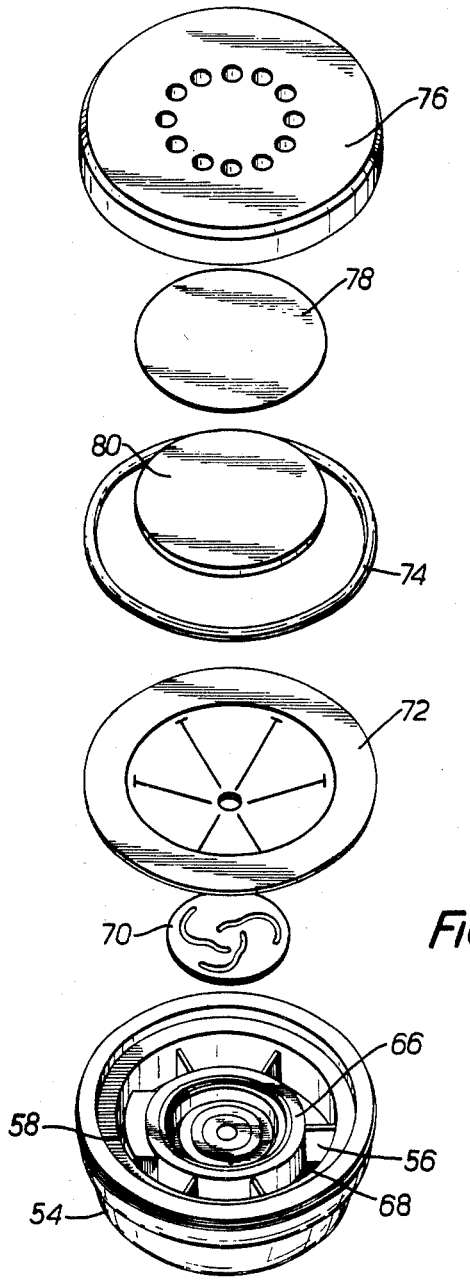

Further features of the invention will become apparent from the following description of an embodiment of the invention given by way of example only with reference to the accompanying drawings in which:

FIG. 1 is a cross-sectional view of an electro-acoustic transducer constructed in accordance with the invention, FIG. 2 is an exploded view of part of the electro-acoustic transducer, FIG. 3 is a cross-sectional view of the part of the electro-acoustic transducer shown in FIG. 2 prior to a moulding process and, FIG. 4 is an exploded view of the final transducer assembly.

Referring first to FIG. 2, the transducer comprises a first plastics housing 10 which is moulded around a hard sintered metal annular ring 12 which will eventually be permanently magnetized. The distance A between the end 14 of the ring 12 and the face of an annular surface 16 is accurately dimensioned during the moulding process to be around 0.007 of an inch (see FIG. 1) An annular coil 18 is then placed over a soft iron core 20 which is formed integrally with a circular soft iron plate 22. The wires from the coil are carried on a short stem 24 which fits into a slot 26 formed in the plate 22. The coil 18 and the integral core 20 and plate 22 are then inserted into the ring 12 and located by the stem 24 which fits into a slot 28 formed in the housing 10. Two terminals 30 and 32 are inserted into blind holes 34 and 36 and the ends of the wires from the coil connected to the terminals by suitable means, such as soldering. The terminals are then bent through 90° into the position shown in FIG. 3 to relieve any strain on the coil wires and facilitate external connection.

The housing 10 is then placed in a press which engages the surface of the plate 22 and the end 14 of the ring 12. As the press pressure is increased the soft iron plate 22 is slightly deformed to correctly seat on the end of the ring 12 and the end of the core 20 is aligned with the end 14 of the ring 12. A plastics cover 38 is now placed on the housing 10 covering the plate 22, the cover being provided with slots 40 and 42 through which the terminals 30 and 32 project.

The first housing assembly is now placed on a moulding die 44 (FIG. 3) on to which is clamped a second die 46. The second die is provided with holes 48 through which the terminals 30 and 32 project and a piston member 50 spring urged by a resilient polyurethane plug 52 contacts the cover 38 to hold the first housing assembly in position.

A suitable housing such as the circular housing 54 is now injection moulded around the first housing assembly, the circular housing forming the outer wall of the transducer and locating the first housing by radially extending webs such as the webs 56 and 58. The rear face 68 of the housing 54 is also moulded to the cover 38 and to the end of the first housing 10 surrounding the cover 38. The cover 38 is provided with a hole 60 which aligns with a hole 62 formed in the plate 22, and during the moulding process molten plastic passes through the holes 60 and 62 into the space between the coil 18 and the ring 12.

Molten plastic also flows in to an annular space 64 to form a circular flange 66 to lock the assembly together.

The transducer is now completed by placing the armature 70 on the surface 16, permanently magnetising the ring 12, bonding the centre of a circular diaphragm 72 to the centre of the armature 70 and securing the outer edge of the diaphragm by a rubber 'O' ring 74 and a cover 76 which is secured on a flange formed on the housing 54. A membrane 78 and a clamping disc 80 is located inside the cover 76 to prevent the ingress of duct etc. The ring 12 is initially magnetically saturated so that the armature 70 is pulled up against the end 14 of the magnet 12 and the end of the core 20. The magnetic 12 is then gradually demagnetized so that the armature moves away from the magnet 12 and the core 20 until the desired amplitude of movement is achieved in the diaphragm 72.

I claim:

1. An electro-acoustic transducer comprising a first moulded plastics housing, an annular magnet, said annular magnet being moulded in said first housing, said first housing including locating means for an annular coil, a stemmed pole piece as a core, an armature and transducer terminals, said coil having electrical connections to said transducer terminals, a plastics cover member abutting said first housing for holding said core and said coil in position and for covering said electrical connections between said coil and said terminals, and a second moulded plastics housing moulded around said first housing, said second housing moulded to and bonding said cover member, said core and said coil in position in said first housing, said second housing partially surrounding said first housing and forming the outer walls of said transducer.

2. A transducer as claimed in claim 1 in which the coil assembly is mounted concentrically within the annular magnet and said second housing being locked to said first housing due to the partial surrounding of the same.

3. A transducer as claimed in claim 2 wherein said annular coil is an annular wound coil, and the end face of the stemmed pole piece being aligned with the end face of the magnet.

4. A transducer as claimed in claim 2 in which the second housing extends into the space between the coil assembly and the annular magnet.

5. A transducer as claimed in claim 2 in which the second housing comprises a circular wall arranged concentrically with the annular magnet.

6. A transducer as claimed in claim 2 in which the armature is circular and is located concentrically with the annular magnet.

7. A transducer as claimed in claim 6 in which the centre of a circular diaphragm is secured to the centre of the armature and the edge of the diaphragm is located on the circular wall of the second housing.

* * * * *